US005305898A

United States Patent [19]

Merl

[11] Patent Number: 5,305,898

[45] Date of Patent: Apr. 26, 1994

[54] MERCHANDISE SADDLE DISPLAY SYSTEM

[76] Inventor: Milton J. Merl, 50 Wilcox Rd., Stonington, Conn. 06830

[21] Appl. No.: 967,167

[22] Filed: Oct. 27, 1992

[51] Int. Cl.[5] ..... A47F 5/00

[52] U.S. Cl. ..... 211/87; 211/59.1; 211/103; 211/106; 248/220.4; 248/221.1

[58] Field of Search ..... 211/59.1, 57.1, 106, 211/103, 87, 94.5; 248/220.4, 221.1

[56] References Cited

U.S. PATENT DOCUMENTS

| | | | |
|---|---|---|---|
| 3,184,068 | 5/1965 | Wende | 211/103 X |
| 3,221,893 | 12/1965 | Glaberson et al. | 211/103 X |
| 3,731,817 | 5/1973 | Fowlkes et al. | 211/94.5 X |
| 4,583,648 | 4/1986 | Buffington et al. | 211/106 X |
| 4,634,010 | 1/1987 | Otema | 211/103 X |
| 4,775,054 | 10/1988 | Dixon | 211/57.1 |
| 5,042,669 | 8/1991 | Goldring | 211/57.1 X |

*Primary Examiner*—Robert W. Gibson, Jr.

*Attorney, Agent, or Firm*—Schweitzer Cornman & Gross

[57] ABSTRACT

A merchandise saddle display system for attachment to a vertical wall of a display case, including a male back containing at least two vertically aligned slots, and means for attaching the male back to the vertical wall, a saddle adapted to be cantilevered from the male back, the saddle having means for supporting at least one merchandise package, and engaging means mounted from the saddle for detachably securing the saddle to the male back, and including at least one engaging member having a body portion and at least one upper and at least one lower tab, each of the tabs being adapted to be received within the slots, the upper and lower tabs being spaced from the body portion, wherein the upper tab is spaced to a greater distance from the body portion than the lower tab for facilitating insertion and removal of the tabs into and from the slots, whereby the saddle is easily removable and replaceable in the vertically aligned slots on the male back.

7 Claims, 9 Drawing Sheets

FIG. 11
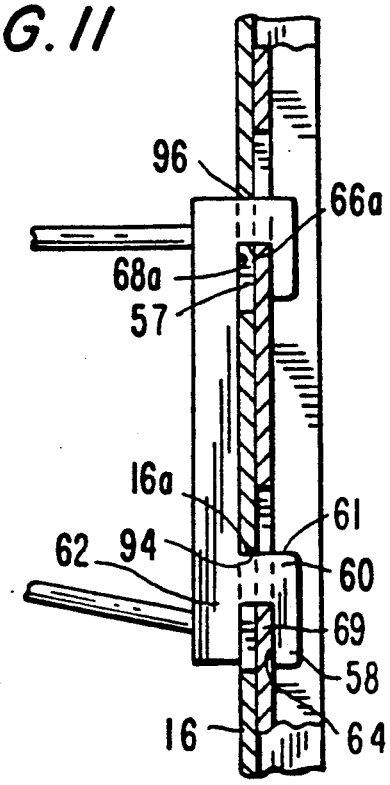
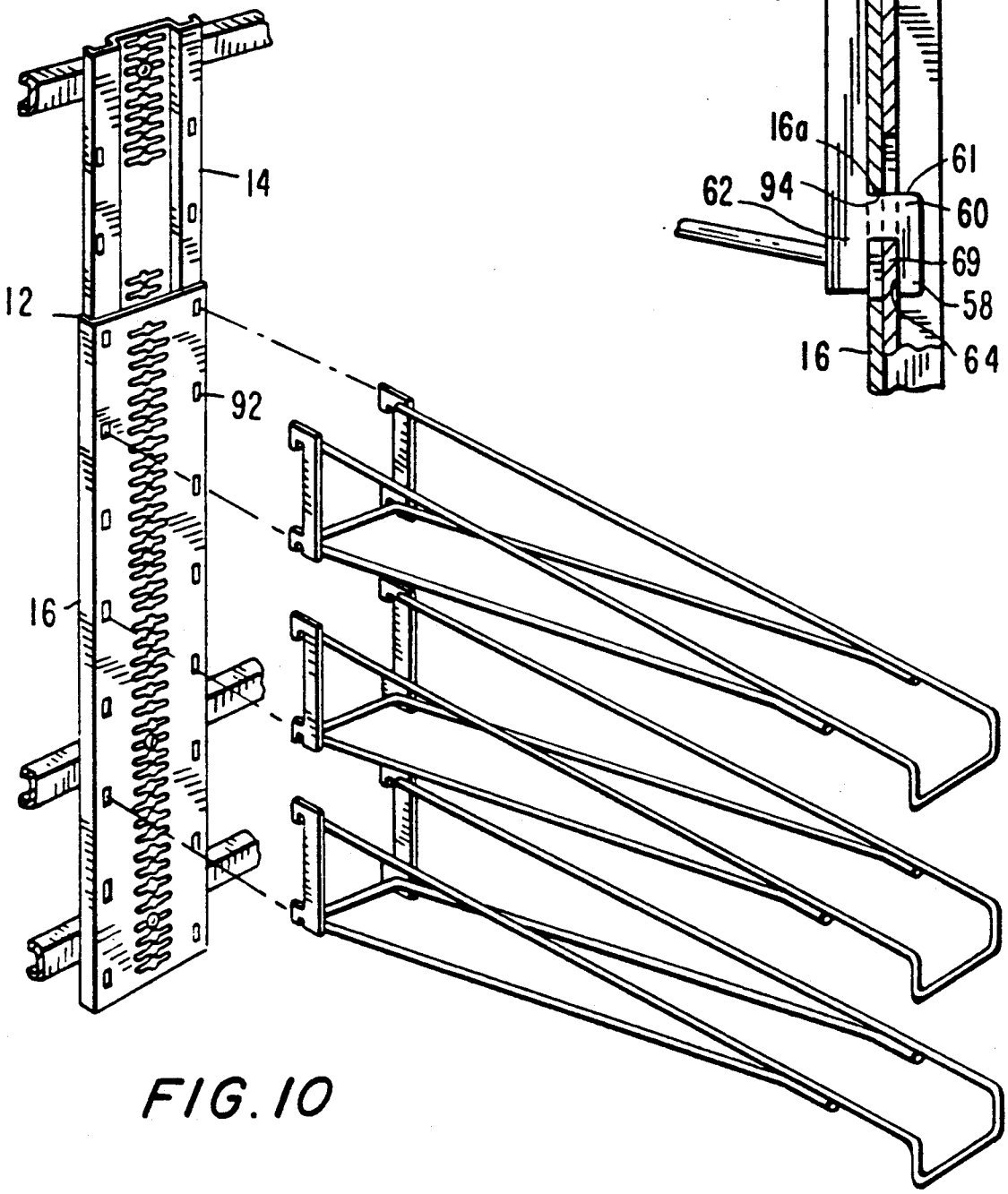
FIG. 10

MERCHANDISE SADDLE DISPLAY SYSTEM

This invention relates to merchandise display systems and more particularly to an improved saddle display system generally for use in a standard cold box.

BACKGROUND AND SUMMARY OF THE INVENTION

Merchandising display systems are old and well known. There are many variations of display systems which are used in supermarkets, groceries, drugstores, and sundry stores. Generally the displays consists of a floor platform with a vertical upright peg board. The board carries either ordinary inserts or specially designed members which can be locked into a desired position.

Refrigerated desserts are normally merchandised in four and six packs in small cups wrapped with a chip board paper sleeve. The current practice is to display them on a double peg hook or standard shelf. The double peg hook is attached to traditional cross or peg bars which are retrofited to be placed in traditional dairy cases containing products such as shredded cheese, sliced cheese, or prepackaged deli, luncheon meat and turkey slices. However the current prior art construction is neither proprietary to the product packaging nor is it particularly efficient. For example, if pudding packaging is hung, the peg hook flap and the needed display space on the top of the package wastes approximately one and one quarter inches of space over each package size. This accounts for approximately thirty percent of the available cubic volume in the refrigerated display cases.

The more efficient a cubic display space is, the more profitable that particular space can be. Thus it is desirable to increase the amount and attractiveness of the inventory presented within the display space.

OBJECTS AND ADVANTAGES OF THE PRESENT INVENTION

An object of the present invention is to develop an improved spacially efficient merchandising display system for the packaging and category of product.

Another object of the present invention is to provide a system which will prevent sag and wasted space by means of a construction which is more rigid than the four traditional pegs.

Yet another object of the present invention is to present a system which is proprietary to a specific package design where three of six product cups are exposed in the product presentation packaging.

Still yet a further object of the present invention is to provide a device which can take the place of current pegs by acting as a retrofit to existing merchandising systems in a modular fashion both horizontally and vertically.

Still a further object of the present invention is to provide a retrofit to a dairy case installation as an independent and new presentation of refrigerator desserts.

Still yet a further object of the present invention is to enable placement of a channel or locator for signage without loss of merchandising space.

A feature of the present invention is to provide a device which uses the minimum number of components for ease of installation and cost effective purchasing and warehousing.

Still yet a further object of the present invention is to provide an improved merchandise display system which will enable easy stocking and maintenance in a neat fashion, thereby lowering store category labor cost.

Still yet another object of the present invention is to provide an improved merchandising system which will be simple and easy to fabricate and yet be economical to a high degree in use.

BRIEF DESCRIPTION OF THE PRESENT INVENTION

The key feature of the present invention is the use of a custom support frame otherwise referred to as the saddle. The saddle has means to carry product all the way to its forward or proximate end. The present invention, which is best utilized in a dairy cold box display case, also includes structure to secure male backs in a vertical position on the vertical central walls of the cold box.

The distal end of the saddle carries a series of tabs which are received within slots in a male back, and generally used for vertical alignment by pairs. When only the male bracket is used and secured to the display box wall, a hook finger on the tab is received within a set of parallel slots, with four slots to accommodate each of the hooks. The hooks have channels which engage the lower edge of the slots and lock into the slots with a cantilever force.

If there is sufficient vertical height in the box to accommodate more rows of product, a female back extension is utilized. It has slots which can be matched up with slots in the male back. Again, the hooks are placed in the slots in the male back. However the tab hook is also designed with a support finger forming the seat of the channel. The finger abuts against the upper wall of the mating slots in the female back, supporting it by means of gravity. This provides an easy means for retaining the system together, and of assembly, disassembly, or repositioning.

Other objects and advantages of the present invention will become apparent when taken in relation to the accompanying drawings in which:

FIG. 1A is a front perspective view in assembled form;

FIG. 10 is a front perspective exploded view with a female extension encompassing the male back; and FIG. 11 is an enlarged partial cross sectional view showing a tab engaging a male back and supporting a female back extension.

DETAILED DESCRIPTION OF THE DRAWINGS

Figure 4:
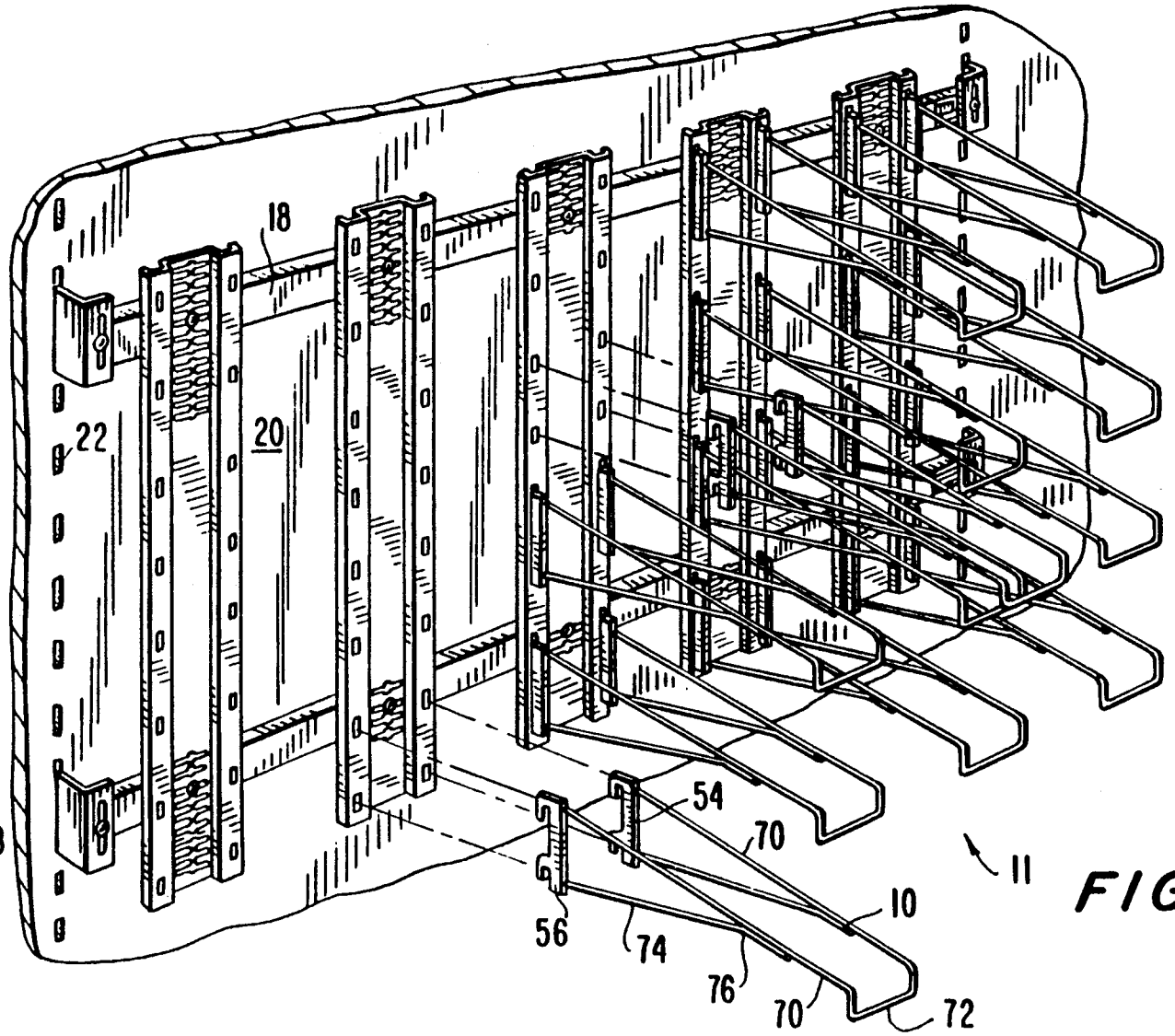
FIG. 4 is a front perspective view showing the saddle members being secured within the slots of the male back.

Turning to the drawings, (FIGS. 4 and 10) there is shown a merchandising display system 11 broadly comprising a saddle 10, and a telescoping support channel 12 (FIG. 10), which includes a male back 14 and a female back extension 16 secured to mounting hardware 18 (FIG. 4). The whole system is then secured to the wall 20 of an upstanding standard display box by means, for example, of slots 22.

Figure 1:
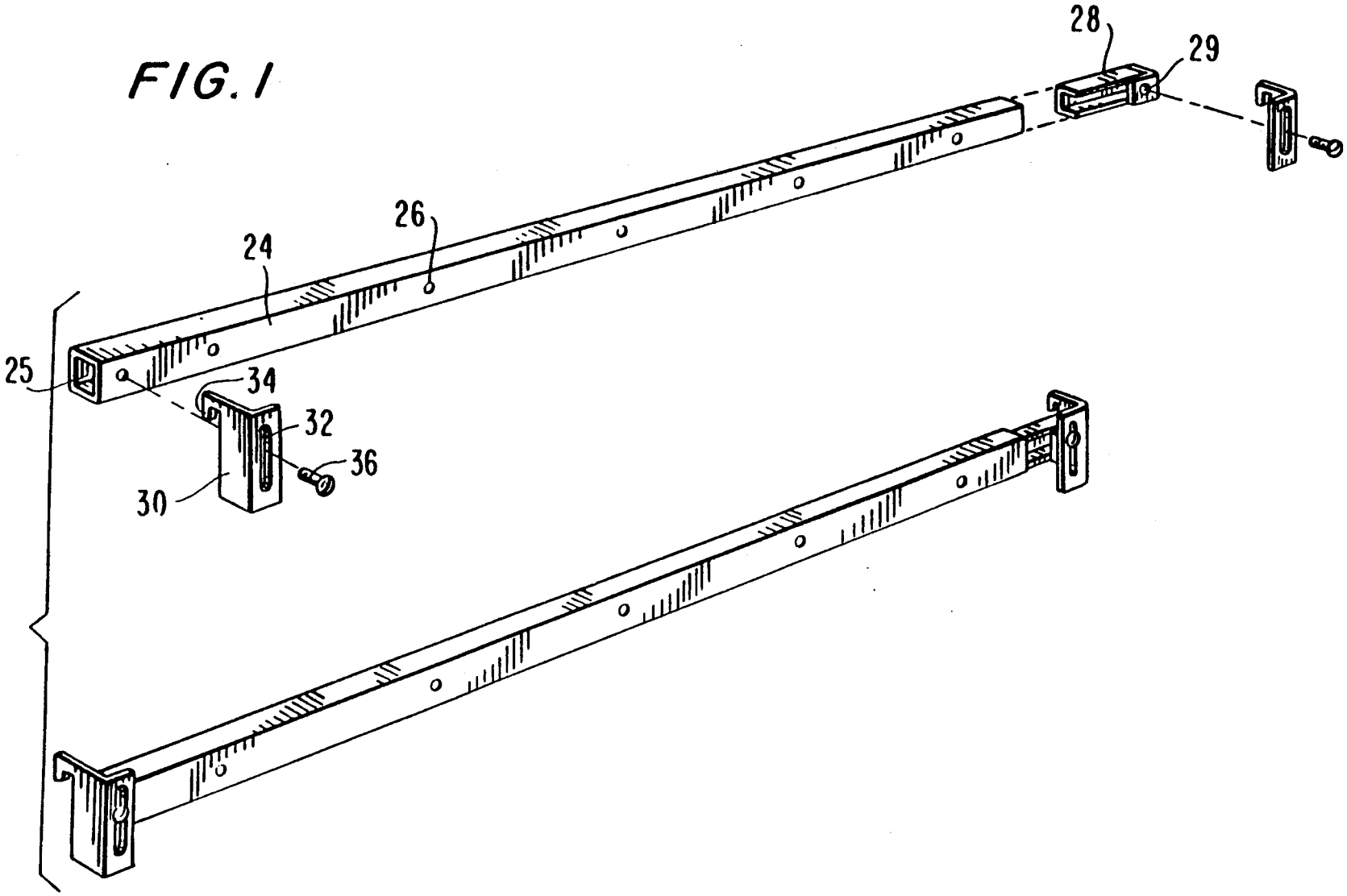
FIG. 1 is a front perspective view showing the present invention mounting hardware in exploded form.

The mounting hardware 18 (FIG. 1) consists of a longitudinal hollow rectangular bar 24 with a series of threaded openings 26. The bars receive extension slides 28 within the hollow openings 25. Each brackets 30, which are essentially angle irons having a forward vertical slot 32 and a rearwardly extending finger 34, may be secured to the threaded openings 29 by means of threaded screws 36. As seen in FIG. 1A, the completed assembly can be adjusted horizontally and vertically along the longitudinal dimension of the slide and the vertical length of slot 32.

Figure 2:
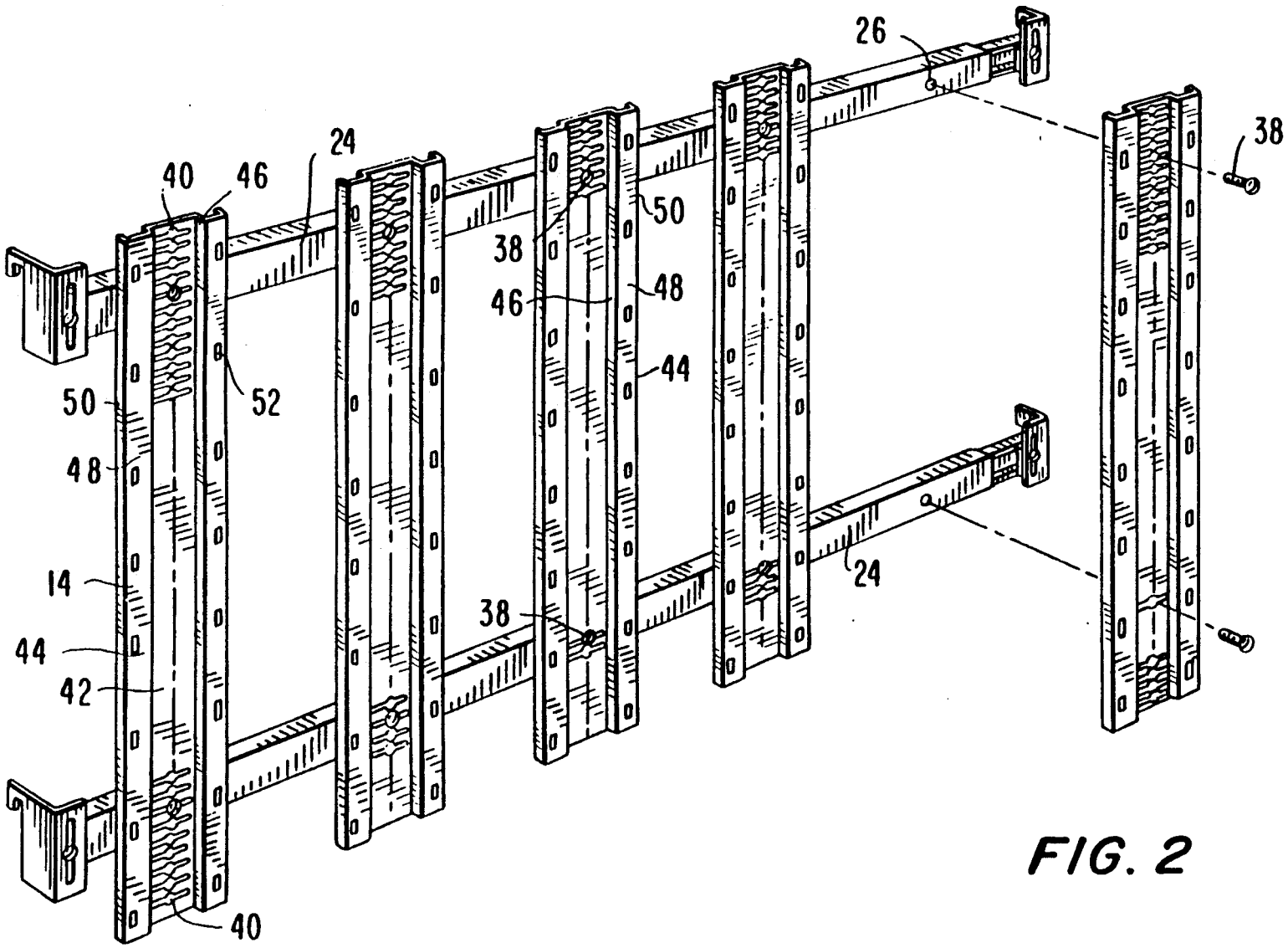
FIG. 2 is a front perspective view showing the mounting hardware as secured to the vertical display case wall (not shown) with the male backs secured thereto, and also showing an exploded view of the assembly of the male back to the mounting hardware.

As seen in FIG. 2, the male backs 14 of the support channel system 12 may then be secured to threaded openings 26 by means of screws 38. The male back member consists of a series of horizontal slots 40 which allow for adjustable vertical positioning with respect to mounting bars 24. Extending from the edge of central portion 42 are arms 44, which are in the form of channels 45 defined by an outwardly extending inner wall 46, a central wall 48, and an inwardly extending outer wall 50. The walls have a series of aligned slots 52.

The location of the male backs 14 relative to the mounting hardware 18 is not critical, although two to three holes in from the end is recommended. If the fixture is to be installed close to the top of the display, then mounting bars should be positioned lower on the male back.

Figure 3:
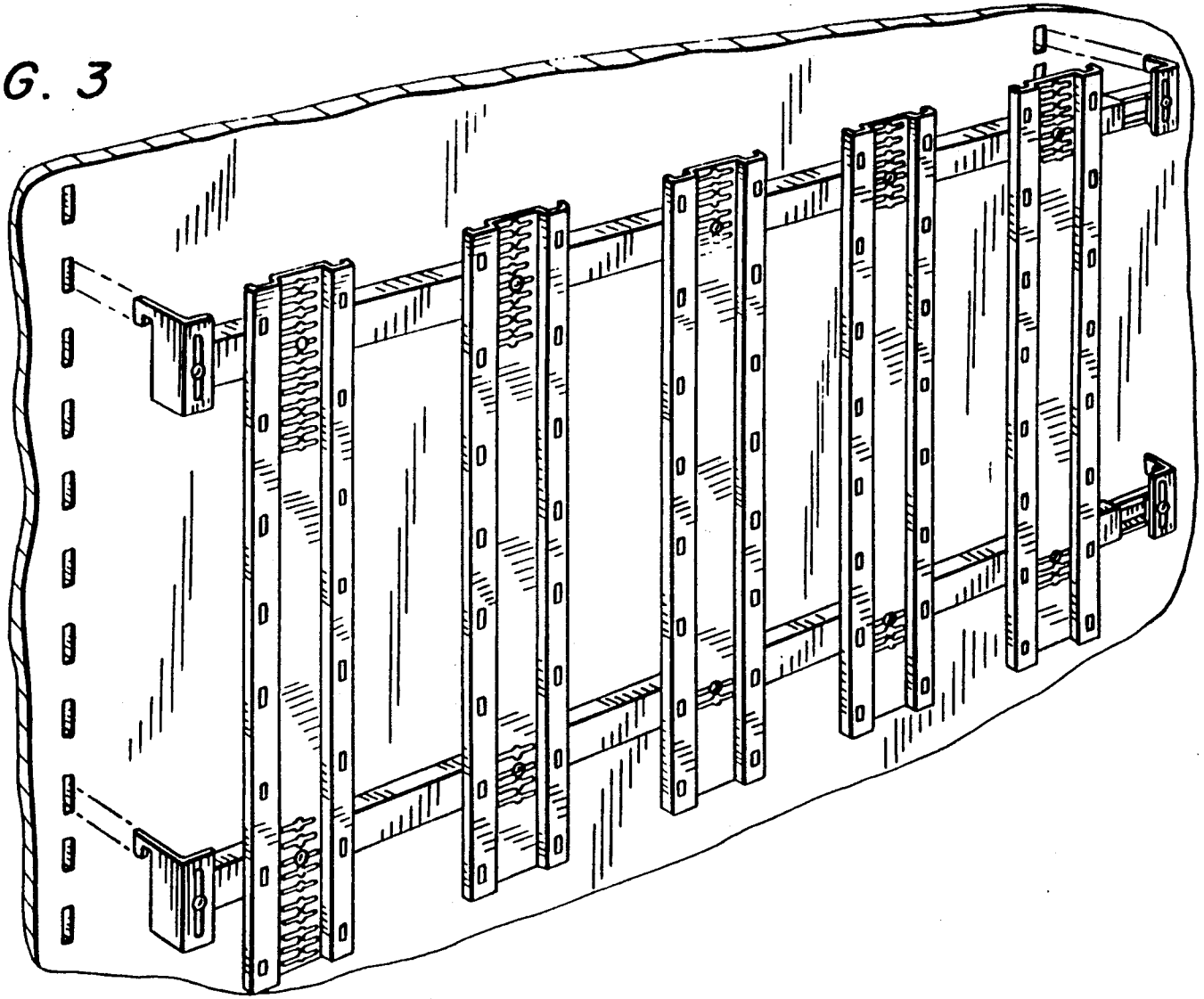
FIG. 3 is a front perspective exploded view showing the assembled unit prior to being received within the slots of the vertical display case wall.

The assembly of the mounting bars and the male backs may then be mounted (FIG. 3) in the cold box or display by slipping the fingers 34 within the slots 22. The end brackets are then tightened while the assembly of the bars and the backs are checked to make certain they are level.

The saddle 10 (FIG. 4) is a simple wire and sheet metal construction. The distal portion consists of two identical engagement members 54. Each member has two identical vertically positioned tabs 56. The tabs (FIG. 5) have a rearwardly, downwardly extending finger portion 58, depending downwardly from an upper support bridge portion 60 and merging into the body portion 62 of the engagement member 54. The three portions of the lower tab form a channel defined by inner surface 64 of the finger, lower surface 66 of the bridge portion, and inner surface 68 of body 62. The channel snugly receives the lower part 69 of male back 14. The upper tab channel is wider (FIG. 11), the surface 68*a* being further disposed from surface 64*a*, the surface 66*a* being longer. This defines an additional space 57 which allows saddle 10 to be easily inserted into and removed from the slots 52 or male back 14. As is obvious from FIG. 11, space 57 must be wider than the thickness of female back 16.

Extending forwardly from the engagement member 54 are two parallel and horizontal upper level wire arms 70 terminating in a loop 72 which is bent downward. The arms 70 are supported by lower upwardly extending arms 74, which engage the arms 70 at 76.

Figure 5:
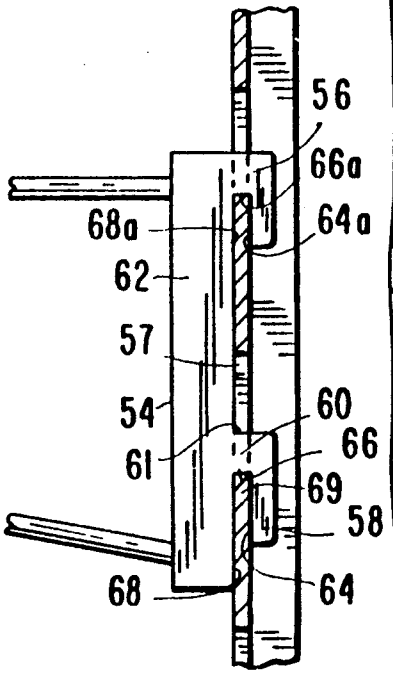
FIG. 5 is an enlarged partial cross sectional view showing a tab being received within a slot of a male back.

As can be seen in FIG. 4 and 5, a saddle 10 is secured to a male back 14 by placing the tabs 56 within the slots 52 where engagement is made. There is a tendency for the unit to pivot around the lower tab 56 resulting from cantilever forces, especially when product is on arms 70. These forces lock the saddle in place by the abutment of surfaces 64, 66, and 68 with the lower part 69 of male back 14. Only surfaces 64*a* and 64*a* engage upper part 69*a* because of space 57.

Figure 6:
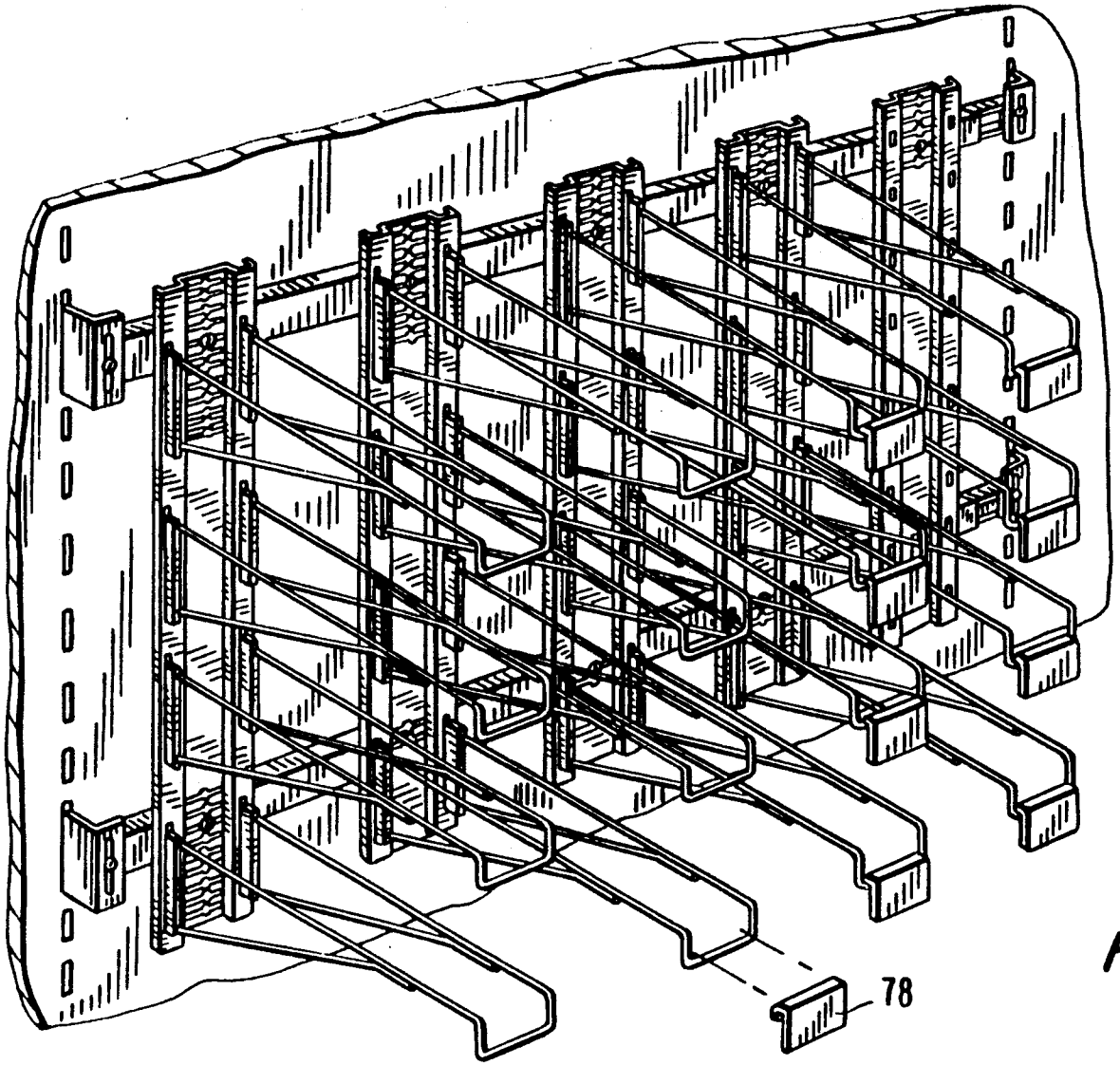
FIG. 6 is a front perspective view of the assembled unit with UPC shelf tag holders placed on the front of the saddles.
Figure 8:
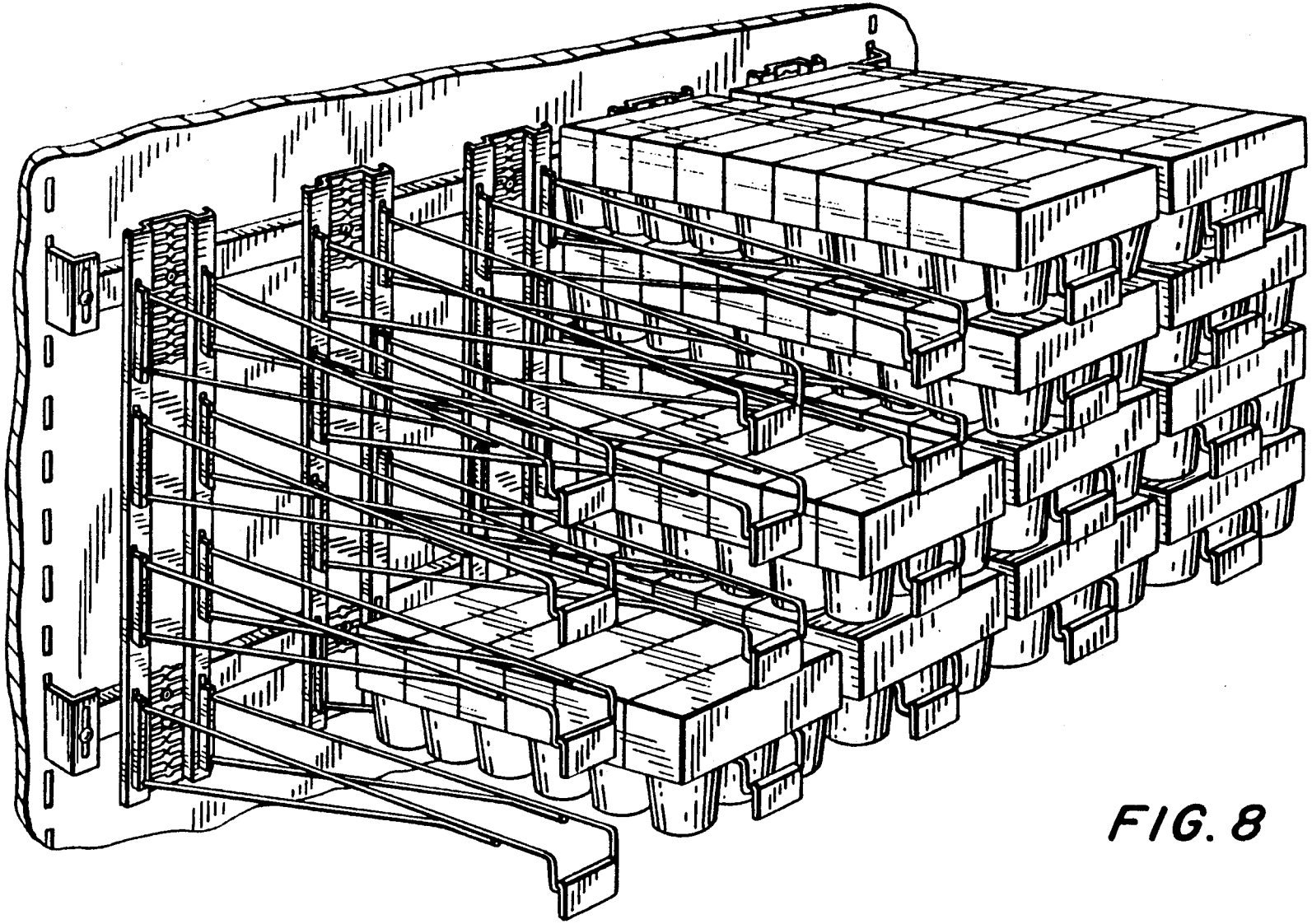
FIG. 8 is a front perspective view showing a significant supply of product mounted on the saddles.

Signs 78 (FIG. 6) can then be hooked upon the loop 72. This is normally done by applying UPC tagholders and then slipping in store UPC tags to match the recommended planigram for the display space. A partial loaded display system with UPC tag holders is shown in FIG. 8.

Figure 9:
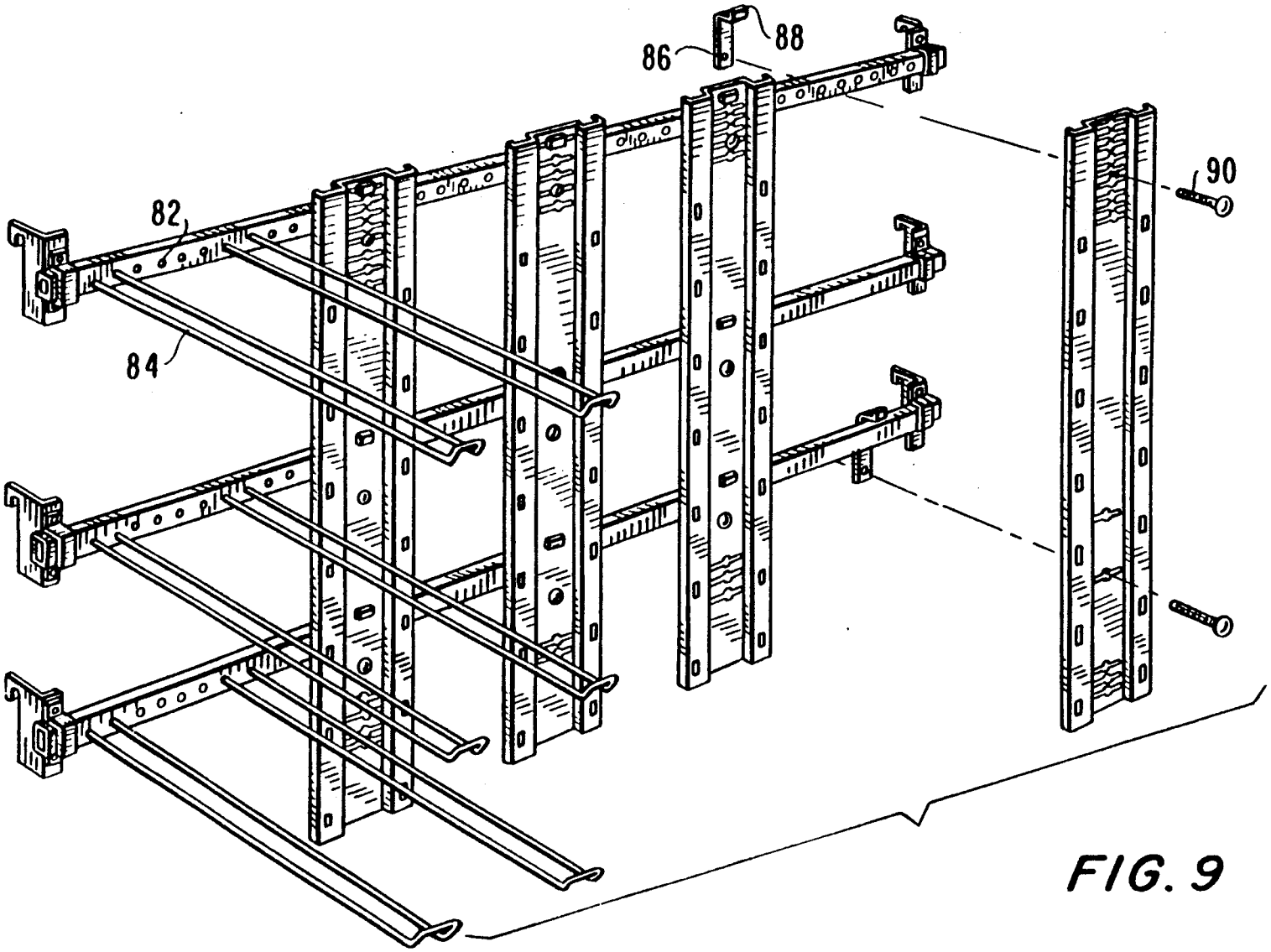
FIG. 9 is a front perspective, exploded view showing a slightly modified embodiment of the present invention with specifically designed clamps secured to cross bars.

FIG. 9 shows a slightly modified view with ordinary horizontal two level cross bars designed to carry other types of merchandise. It also illustrates the use of custom designed clamps 80 which may be secured to the cross bars which are found in older display boxes. The bars have a series of holes 82 into which extension display members, comprising product supports 84 to carry lighter merchandise may be inserted. The clamps 80 have a threaded opening at 86 and an upwardly extending angle iron finger 88. The clamps are placed over the bars, the lip 88 is passed through one of the horizontal slots of 40, and a screw 90 is passed through one of the lower slots and through the threaded opening 86 in order to secure the male backs to the bars.

Figure 7:
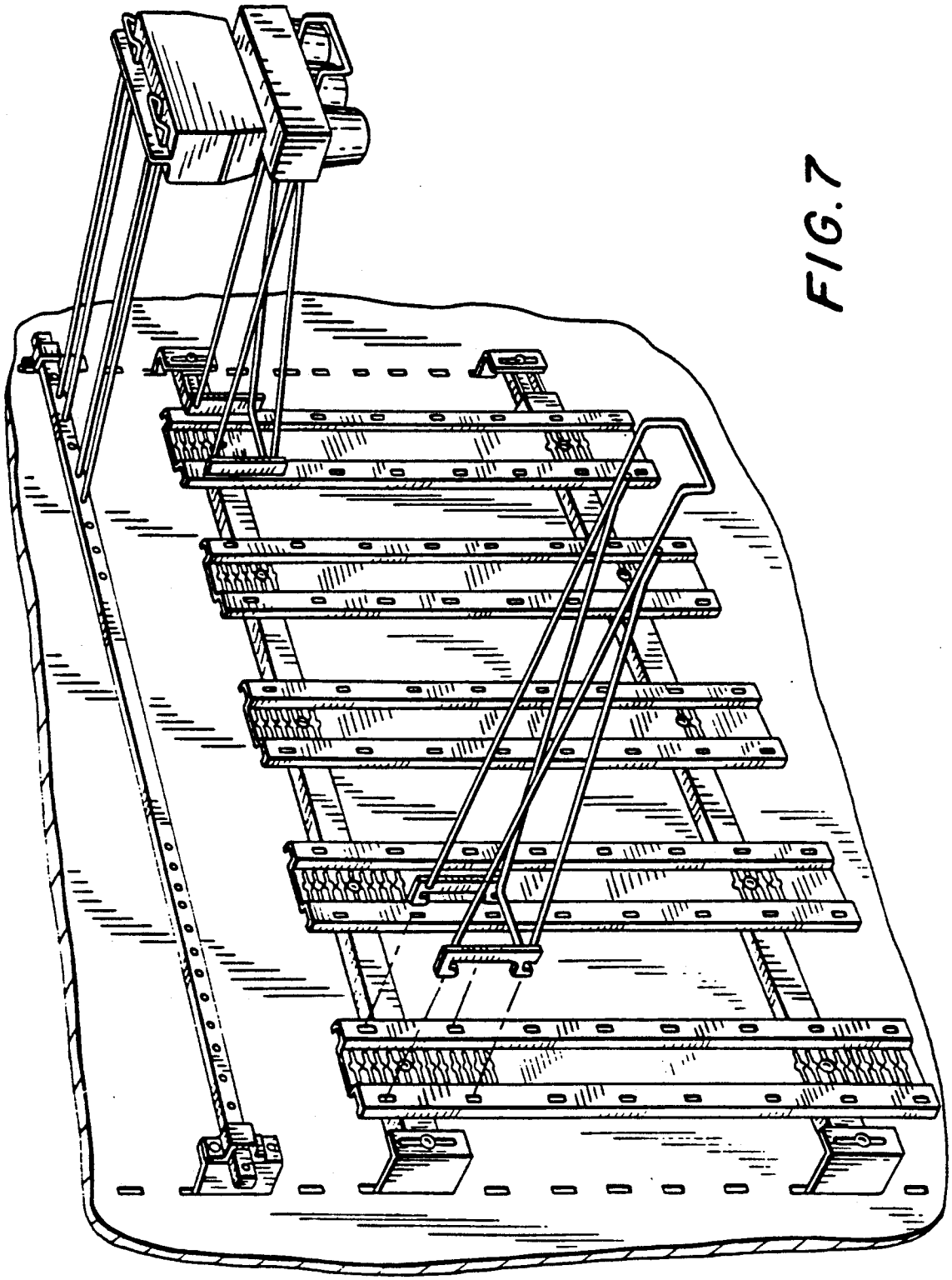
FIG. 7 is a front perspective view with a top extension display member secured to a cross bar and showing one package of different merchandise positioned for sale.

FIG. 7 shows the cross bars carrying product supports 84 placed above the new construction and side-by-side (FIG. 9). This illustrates use of prior art display with the invention, minimizing unutilized space.

The display space may be more fully utilized if sufficient vertical depth is available by securing the sliding female back extension 16 to the male back 14. The female back extension matches the general dimensions of the male back and is mounted around the outer channel members 45 being spaced away from the inner central portion 42 (FIG. 10), such that the female back can slide up and down along the male back. The female back carries slots 92 which may be aligned with slots 52 in the manner hereafter described. In order to utilize the female backs, the unit is slid into a desired vertical position with the male and female back slots 52, 92 in alignment. Then the saddle tabs are passed through both sets of slots so that the fingers 58 engage the male backs as previously described. However with the addition of the female back (FIG. 11), the fingers 58 continue to engage the male back but the female back fits within additional space 57 so that the upper edge 16*a* of the female back slot is supported by the top surface 61 of the bridge portion 60 in a gravity fit. The vertical height of portion 62 is less than the distance between the outermost edges or to vertically adjacent slots 92. Thus, the single engagement member of the saddle can accommodate either the male back alone or the male and female backs where the female portion is supported by gravity. It is also possible to construct a saddle engagement member so that the panel formed on the lower tab of the same dimension as space 57 is not present so that the two tabs 58 may be more easily formed from a manufacturing point of view. However, the effectiveness is diminished.

Thus there is formed a traditional slide or curtain-rod type construction between the backs The male backs may be bolted in place with the female backs freely moving vertically for proper adjustment. The mounting hardware is of simple construction with vertical adjustment along discreet slots in the vertical wall.

Refrigerated desserts, normally merchandised in four and six packs and small cups, can be easily attached, maintained, and positioned with a significantly larger amount of product being displayed than current displays. The invention provides a much more efficient space presentation and eliminates normal peg merchandising and standard shelving now used to support these products. The components are totally modular both vertically and horizontally, allowing simple distribution, installation, and inventory.

The adjustable back member and saddle construction together, independent of any secondary hardware, is a significant constructional advance over the prior art. The assembly of slots and tabs allowing for the marriage of the saddle to the male and female backs locks the saddle in place and prevents sliding of the overlapping components.

Finally the rotating sign allows easy identification of price and product and allows easy loading and unloading of neighboring product.

I claim:

1. A merchandise saddle display system for attachment to a vertical wall of a display case, which comprises (a) a male back containing at least two vertically aligned slots, and means for attaching said male back to the vertical wall;

(b) a saddle adapted to be cantilevered from said male back, said saddle having means for supporting at least one merchandise package; and (c) engaging means mounted from said saddle for detachably securing said saddle to said male back, and including at least one engaging member having a body portion and at least one upper and at least one lower tab, each of said tabs being adapted to be received within said slots, said upper and lower tabs being spaced from said body portion, wherein said upper tab is spaced to a greater distance from said body portion than said lower tab for facilitating insertion and removal of the tabs into and from said slots, whereby said saddle is easily removable and replaceable in vertically aligned slots on the male back.

2. The merchandise saddle display system of claim 1, wherein said engaging means further comprises bridging means having an upper supporting bridging portion with a proximate end and a distal end, and a finger portion on each of said tabs extending rearwardly and downwardly from the distal end of said upper supporting bridging portion and merging into said body portion.

3. The merchandise saddle display system of claim 2, said finger portion having an inner surface, said upper supporting bridging portion having upper and lower surfaces, and said body portion having an inner surface, wherein the surface of the finger portion of said upper and said lower tabs each forms a channel adapted snugly to receive said male back for cantilevered engagement therein.

4. The merchandise saddle display system of claim 3, further comprising a female back extension slidable on said male back for varying their relative positions, said female back extension having a plurality of slots for alignment with the slots in said male back, the slots in said female back extension having upper inner surfaces therein, the channel of the upper tab being of sufficient width for accommodating said male back and said female back extension, said female back extension being supported from said upper surface of said upper supporting bridging portion, the upper inner surfaces of said slots in said female back extension rest on said upper surface of said upper supporting bridging portion, the proximate end of said bridging portion being secured to said body portion, said engaging means being formed from said bridging portion, said body portion, and said finger portion, forming said engaging means, whereby said female back extension is held fast between said male back and said body portion.

5. In a merchandise saddle display system for attachment to a vertical wall of a display case, and having a male back containing a plurality of slots, and means to attach the male back to said vertical wall, the improvement which comprises a saddle having means for supporting at least one merchandise package, engaging means mounted from said saddle for detachably securing said saddle to said male back, said saddle having two substantially horizontal parallel bars attached to said engaging means and extending forwardly therefrom, said means to support being adapted to accommodate merchandise thereon.

6. The merchandise saddle display system of claim 5, wherein said means for supporting has a forward end, and a cross piece attached to the forward end.

7. The merchandise saddle display system of claim 6, further comprising a rotating sign, and means for attaching said rotating sign from said cross piece.

* * * * *